US009009890B2

(12) United States Patent
Robson

(10) Patent No.: US 9,009,890 B2
(45) Date of Patent: Apr. 21, 2015

(54) VALANCE

(71) Applicant: The Fine Cotton Company, London (GB)

(72) Inventor: Jane Margaret Robson, London (GB)

(73) Assignee: The Fine Cotton Company, London (GB)

( * ) Notice: Subject to any disclaimer, the term of this patent is extended or adjusted under 35 U.S.C. 154(b) by 0 days.

(21) Appl. No.: 14/272,702

(22) Filed: May 8, 2014

(65) Prior Publication Data

US 2014/0338128 A1 Nov. 20, 2014

(30) Foreign Application Priority Data

May 17, 2013 (GB) ..... 1308895.0

(51) Int. Cl.
*A47C 21/02* (2006.01)
*A47G 9/02* (2006.01)

(52) U.S. Cl.
CPC ..... *A47G 9/0292* (2013.01); *A47G 9/0238* (2013.01); *A47G 9/02* (2013.01); *A47C 21/028* (2013.01)

(58) Field of Classification Search
CPC ..... A47C 21/00; A47C 21/02; A47C 21/022; A47C 21/028; A47C 21/06; A47G 9/00; A47G 9/02; A47G 9/0238; A47G 9/0292; A47G 9/0284
USPC ..... 5/482, 485, 486, 487, 488, 493, 494, 5/499
See application file for complete search history.

(56) References Cited

U.S. PATENT DOCUMENTS

| | | | | |
|---|---|---|---|---|
| 4,686,726 | A * | 8/1987 | Dunfee | 5/485 |
| 5,086,531 | A * | 2/1992 | Carlos | 5/493 |
| 5,483,712 | A * | 1/1996 | Greenwood | 5/493 |
| 5,636,393 | A * | 6/1997 | Zafiroglu et al. | 5/499 |
| 5,638,562 | A * | 6/1997 | Masoncup | 5/493 |
| 5,715,553 | A * | 2/1998 | Baron et al. | 5/493 |
| 6,035,469 | A | 3/2000 | Schrougham | |
| 6,792,632 | B2 * | 9/2004 | Cohen | 5/493 |
| 6,883,192 | B1 * | 4/2005 | Rose et al. | 5/493 |
| 6,912,745 | B2 * | 7/2005 | Masoncup | 5/493 |
| 6,925,667 | B2 * | 8/2005 | Cohen | 5/493 |
| 7,207,078 | B1 * | 4/2007 | Lakic | 5/493 |
| 7,398,569 | B2 * | 7/2008 | Sakaldasis et al. | 5/488 |
| 7,793,370 | B2 * | 9/2010 | Hampton | 5/493 |
| 8,156,584 | B1 * | 4/2012 | Hart | 5/493 |

(Continued)

FOREIGN PATENT DOCUMENTS

| | | | |
|---|---|---|---|
| GB | 2491625 | A | 12/2012 |
| WO | 2010091482 | A1 | 8/2010 |

OTHER PUBLICATIONS

Patents Act 1997: Search Report under Section 17(5), Application No. GB1308895.0, dated Oct. 28, 2013.

*Primary Examiner* — Robert G Santos
*Assistant Examiner* — David E Sosnowski
(74) *Attorney, Agent, or Firm* — MacMillan, Sobanski & Todd, LLC

(57) ABSTRACT

A valance for a bed includes an attachment portion having one or more installation pockets. The attachment portion is configured to lie between a mattress and a bed frame. The valance also includes a skirt portion that is attached to an outer periphery of the attachment portion and depends downwardly from the attachment portion when the valance is installed onto the bed.

14 Claims, 2 Drawing Sheets

(56) References Cited

U.S. PATENT DOCUMENTS

| | | | | |
|---|---|---|---|---|
| 8,214,948 | B2 * | 7/2012 | Gatzke et al. | 5/493 |
| 8,245,333 | B2 * | 8/2012 | Hamilton et al. | 5/493 |
| 8,393,024 | B2 * | 3/2013 | Mitchell | 5/493 |
| 8,522,377 | B2 * | 9/2013 | Hart | 5/482 |
| 8,627,521 | B2 * | 1/2014 | Rowson et al. | 5/496 |
| 8,650,681 | B2 * | 2/2014 | Masoncup | 5/493 |
| 8,671,477 | B1 * | 3/2014 | Joyner | 5/493 |
| 2003/0028965 | A1 | 2/2003 | Wooten, Jr. et al. | |
| 2004/0154102 | A1 | 8/2004 | Cohen | |
| 2004/0231053 | A1 | 11/2004 | Masoncup | |
| 2004/0237197 | A1 * | 12/2004 | Cohen | 5/493 |
| 2009/0049607 | A1 * | 2/2009 | Van Sice | 5/493 |
| 2009/0089929 | A1 * | 4/2009 | Hampton | 5/493 |
| 2011/0308013 | A1 * | 12/2011 | Kennett | 5/493 |
| 2011/0314603 | A1 * | 12/2011 | Rowson et al. | 5/488 |
| 2012/0060281 | A1 * | 3/2012 | Mitchell | 5/493 |
| 2012/0233775 | A1 * | 9/2012 | Flinn | 5/493 |
| 2012/0297541 | A1 * | 11/2012 | Brown | 5/490 |
| 2014/0000029 | A1 * | 1/2014 | Masoncup | 5/493 |
| 2014/0090170 | A1 * | 4/2014 | Mothorn | 5/493 |

* cited by examiner

VALANCE

CROSS-REFERENCE TO RELATED APPLICATIONS

This application claims priority from U.K. Patent Application No. 1308895.0, filed May 17, 2013. The disclosure of that application is incorporated herein by reference.

BACKGROUND OF THE INVENTION

Valances (also known as bed skirts) generally comprise a piece of fabric that is placed between a mattress and a bed frame, a portion of the fabric being arranged to hang down to cover at least a portion of the bed frame below the mattress. Valances are decorative items that give an aesthetically pleasing appearance to a bed by covering the sides of the bed frame and/or any items that may be stored under the bed.

It is known to provide a valance that is generally rectangular in form with a central solid rectangular portion which has substantially the same footprint as the bed frame to which the valance is installed. A skirt portion is also provided on the valance, which extends outwards from the central portion, hanging towards the floor.

However, installation of such valances require the removal of the mattress from the bed frame because the central solid rectangular portion cannot be installed with the mattress in place.

It is also known to provide a valance that may be installed without the removal of the mattress from the bed frame. Such valances may be substantially U-shaped or may comprise component portions that are attached to the separate sides of the bed and may be installed by inserting the valance between the mattress and the bed frame.

However, it is difficult to install the valance because it is difficult to grip when inserting it between the mattress and the bed frame.

The present invention seeks to address these issues.

SUMMARY OF THE INVENTION

According to a first aspect of the present invention, there is provided a valance for a bed, the valance comprising: an attachment portion comprising one or more installation pockets, wherein the attachment portion is configured to lie between a mattress and a bed frame; and a skirt portion, which is attached to an outer periphery of the attachment portion and is configured to hang down from the attachment portion when the valance is installed onto the bed.

The installation pockets may be configured to allow the attachment portion to be pushed between the mattress and the bed frame using a hand and/or a tool. The installation pockets may be provided around the inner periphery of the attachment portion. The installation pockets may be integral to the attachment portion. The installation pockets may be formed in the attachment piece by making a fold from the inner periphery towards the outer periphery of the attachment portion such that an open edge faces the outer periphery of the attachment portion and a closed edge forms the inner periphery of the attachment portion.

The fold in the attachment portion may comprise one or more lines of stitching running between to the edges of the fold, the lines of stitching being configured to form a plurality of installation pockets in the fold. The lines of stitching may be spaced apart by approximately 20 cm to 30 cm. The fold may be approximately 14 cm deep. The attachment portion may be approximately 40 cm wide.

The attachment portion may be substantially U-shaped. The attachment portion may comprise first and second spaced apart parallel side sections, which are joined to each other at their first ends by a third side section, which extends between the first and second side sections and is perpendicular thereto, and wherein the second ends of the first and second side sections are disconnected from one another.

The first ends of the first and second side sections may form mitered corners with the third side section. The first ends of the first and second side sections may overlap or abut against the ends of the third side section. The first, second, and third side sections may each be substantially rectangular.

The attachment portion may be configured such that it has sufficient width that it can be gripped between the mattress and the bed frame without additional fixing means. The attachment portion and/or the skirt portion may be inelastic. The attachment portion and/or skirt portion may be made from an elastic material. The attachment portion may comprise a single piece of fabric. The skirt portion may comprise a single piece of fabric. The skirt portion may comprise pleats and/or vents. The attachment portion may be planar in use. The attachment portion may comprise fabric only.

According to a second aspect of the present invention there is provided a valance for a bed, the valance comprising: an attachment portion comprising one or more formations to facilitate tucking in of the attachment portion, wherein the attachment portion is configured to be tucked between a mattress and a bed frame; and a skirt portion, which is attached to an outer periphery of the attachment portion and is configured to hang down from the attachment portion when the valance is installed onto the bed.

The formations may be configured to allow the attachment portion to be tucked between the mattress and the bed frame using a hand and/or a tool. The installation components may comprise eyelets, tabs, straps or any other appropriate feature that may allow the attachment portion to be tucked between the mattress and the bed frame using a hand and/or a tool.

The second aspect of the present invention may be used in conjunction with the first aspect of the present invention and/or any of the optional features described in relation to the first aspect of the present invention as set out above.

Various aspects of this invention will become apparent to those skilled in the art from the following detailed description of the preferred embodiments, when read in light of the accompanying drawings.

DETAILED DESCRIPTION OF THE PREFERRED EMBODIMENTS

Figure 1:
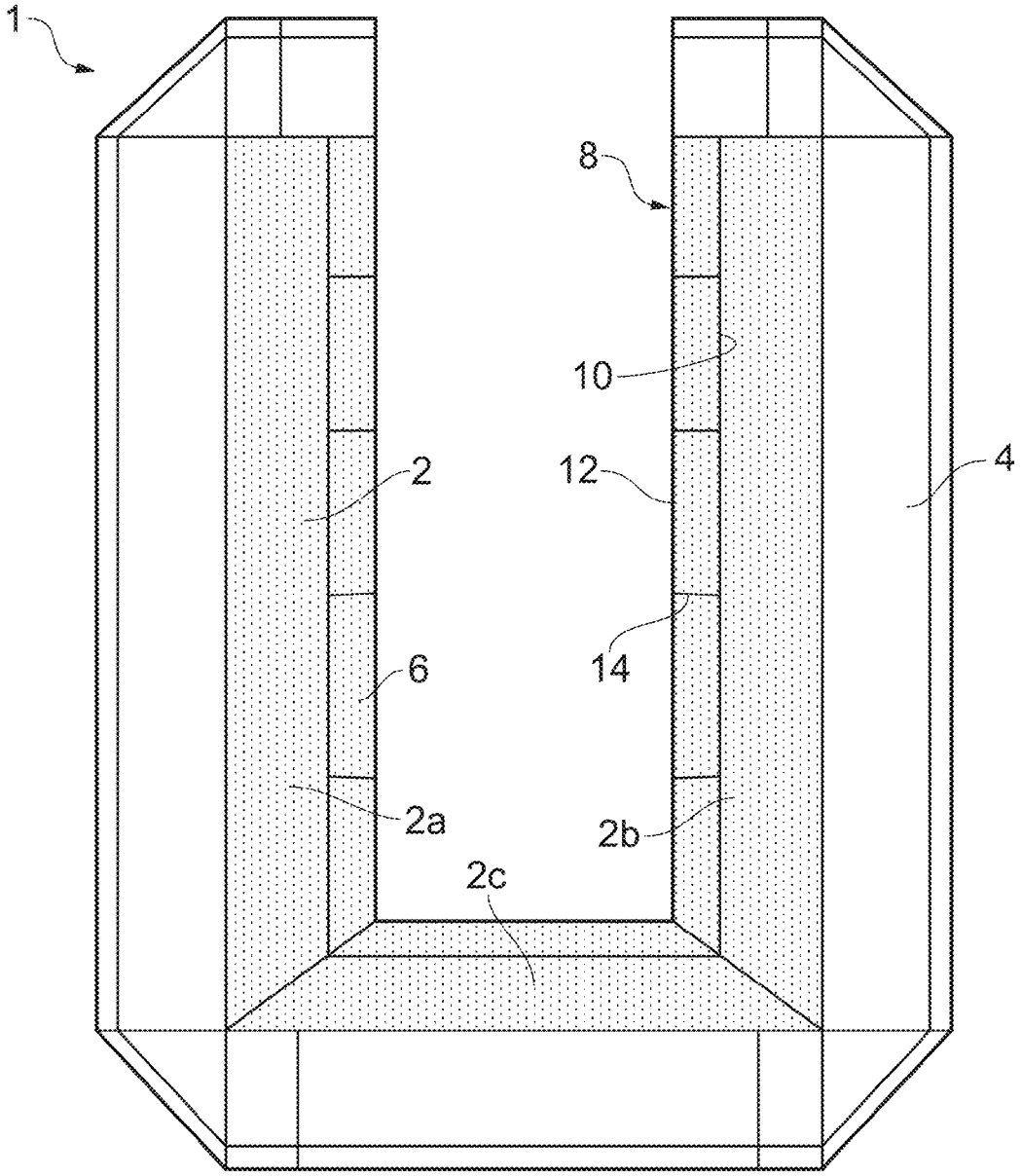
FIG. 1 shows a first example of a valance with mitered corners.
Figure 2:
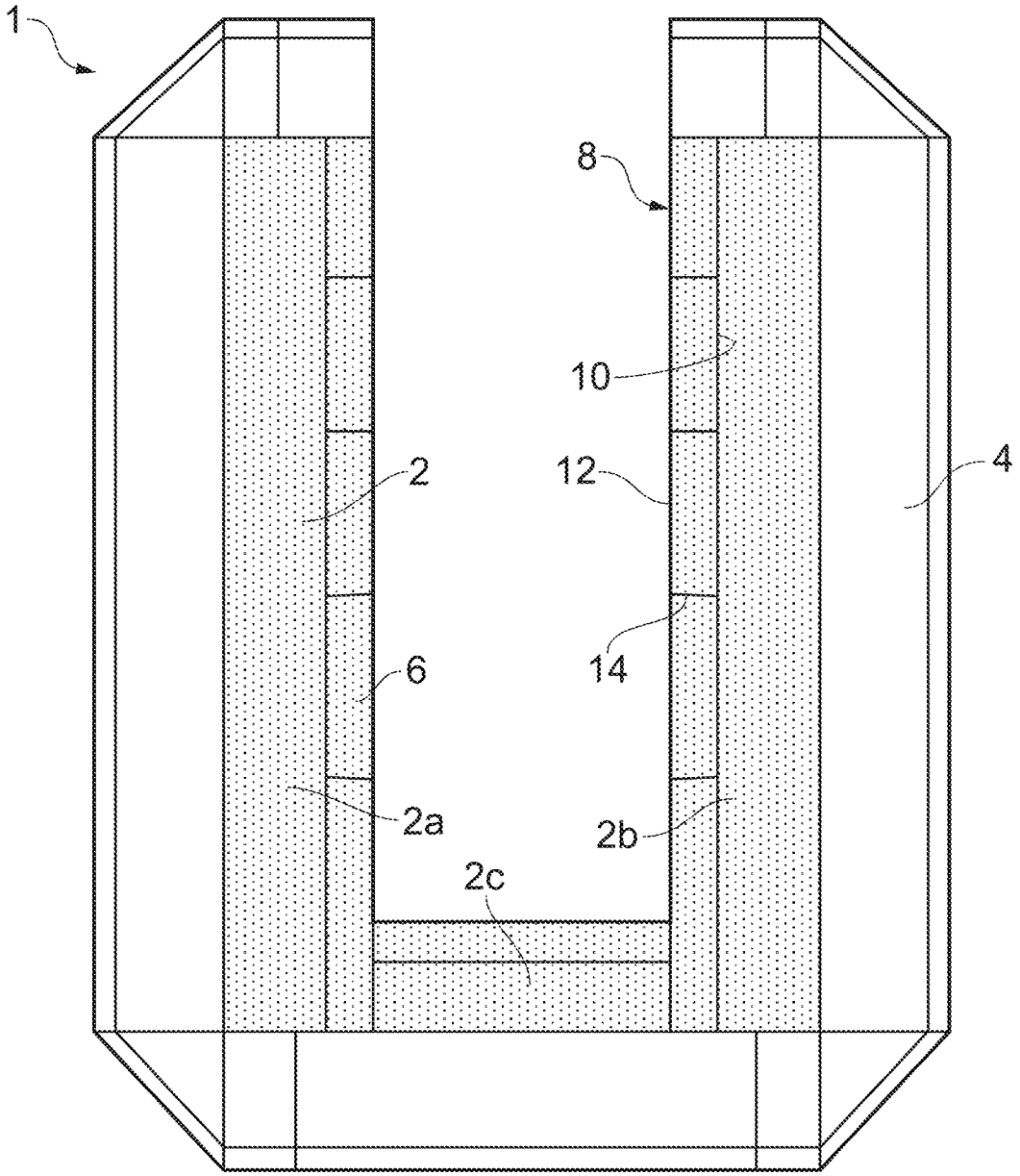
FIG. 2 shows a second example of a valance with non-mitered corners.

FIGS. 1 and 2 show a valance 1 that may be installed easily onto a bed without the removal of a mattress. The valance 1 comprises an attachment portion 2 and a skirt portion 4. The attachment portion 2 comprises one or more installation pockets 6. The attachment portion 2 is configured to lie between a mattress and a bed frame. The skirt portion 4 is attached to an outer periphery of the attachment portion 2 and is arranged to hang down from the attachment portion 2 when the valance is installed onto the bed.

In the examples shown in FIGS. 1 and 2, the installation pockets 6 are provided around the inner periphery of the attachment portion 2, the installation pockets 6 being formed integrally to the attachment portion 2. The installation pockets 6 may, however, be formed separately to the attachment portion 2 and subsequently attached using stitches, glue, or any other appropriate attachment means. The installation pockets 6 may be constructed from fabric or any other appropriate material from which a substantially planar pocket may be formed.

In the examples shown in FIGS. 1 and 2, the installation pockets 6 are formed in the attachment piece 2 by making a fold 8 from the inner periphery towards the outer periphery of the attachment portion 2 such that an open edge 10 faces the outer periphery of the attachment portion 2 and a closed edge 12 forms the inner periphery of the attachment portion 2.

The fold 8 may comprise one or more lines of stitching 14 running between the edges 10, 12 of the fold 8, the lines of stitching 14 being configured to form a plurality of installation pockets 6 in the fold 8. The installation pockets 6 are configured to allow the attachment portion 2 to be easily pushed between the mattress and the bed frame, using a hand and/or a tool, such that the desired installation is easily and repeatedly achieved. In the examples shown, the lines of stitching 14 are spaced apart by approximately 20 cm to 30 cm and the fold 8 is approximately 14 cm deep, although the installation pockets 6 may be of any general dimensions that allow for the insertion of a hand and/or tool.

In the examples shown in FIGS. 1 and 2, the attachment portion 2 is substantially U-shaped and comprises a plurality of side sections. The attachment portion 2 comprises first and second spaced apart parallel side sections 2*a*, 2*b* configured to extend along the length of the bed. The first and second side sections 2*a*, 2*b* are joined to each other at their first ends by a third side section 2*c*. The third side section 2*c* extends across the width of the bed perpendicularly between the first ends of the first and second side sections 2*a*, 2*b*. The second ends of the first and second side sections 2*a*, 2*b* are not connected to each other. The side sections 2*a*, 2*b*, 2*c* are joined by stitching or otherwise. The first ends of the first and second side sections 2*a*, 2*b* may form mitered corners with the third side section 2*c*, as shown in FIG. 1, or may simply overlap or abut, as shown in FIG. 2.

In another embodiment, not illustrated, the first, second and third side sections 2*a*, 2*b*, 2*c* may be separate components such that they may be installed individually onto the bed. In a further embodiment, not illustrated, the attachment portion 2 may be formed from a single piece of material.

In the examples shown in FIGS. 1 and 2, all of the side sections 2*a*, 2*b*, 2*c* have a width of approximately 40 cm, although the width of each side section 2*a*, 2*b*, 2*c* may not necessarily be the same. The side sections 2*a*, 2*b*, 2*c* may have any sufficient width such that they may be securely gripped between the mattress and the bed frame without the need for any additional fixation. By virtue of such an arrangement, manufacturing costs are reduced and the product remains simple to use.

In the examples shown in FIGS. 1 and 2, the skirt portion 4 is attached along the entire outer periphery of the attachment portion 2. The skirt portion 4 may comprise the same piece of fabric as the attachment portion 2 or may be provided by one or more further pieces of fabric that attach along the outer periphery of the attachment portion 2 by stitching or other appropriate means.

The skirt portion 4 may comprise one or more pleats, which add to the aesthetic of the valance and allow the side sections of the skirt portion to lie parallel to the sides of the bed frame. The skirt portion 4 may comprise one or more vents that allow access to items stored under a bed without the need to lift/remove the valance. Corner pleats may be provided at each of the four outer corners of the valance 1, and one or more side pleats may be provided centrally on each side section. The corner pleats may comprise a triangular section that lies between adjacent rectangular sections that extend along respective peripheral edges of the attachment portion 2. The corner pleats may comprise openings provided of any suitable form to allow for features of the bed frame to be accommodated, such as bed frame head and footer boards.

The principle and mode of operation of this invention have been explained and illustrated in its preferred embodiments. However, it must be understood that this invention may be practiced otherwise than as specifically explained and illustrated without departing from its spirit or scope.

What is claimed is:

1. A valance for a bed, the valance comprising:

an attachment portion including one or more installation pockets, wherein the attachment portion is configured to lie between a mattress and a bed frame; and a skirt portion, which is attached to the attachment portion and is configured to hang down from the attachment portion when the valance is installed between a mattress and a bed frame, wherein the one or more installation pockets are formed in the attachment portion by a fold from an inner periphery towards an outer periphery of the attachment portion such that an open edge faces the outer periphery of the attachment portion and a closed edge forms the inner periphery of the attachment portion.

2. A valance as claimed in claim 1, wherein the one or more installation pockets are configured to allow the attachment portion to be pushed between the mattress and the bed frame using a hand and/or a tool.

3. A valance as claimed in claim 1, wherein the one or more installation pockets are provided around the inner periphery of the attachment portion.

4. A valance as claimed in claim 1, wherein the one or more installation pockets are integral to the attachment portion.

5. A valance as claimed in claim 1, wherein the fold comprises one or more lines of stitching running between the open and closed edges, the one or more lines of stitching being configured to form the one or more installation pockets.

6. A valance as claimed in claim 1, wherein the attachment portion is substantially U-shaped.

7. A valance as claimed in claim 1, wherein the attachment portion comprises first and second spaced apart parallel side sections which are joined to each other at respective first ends by a third side section, which extends between the first and second side sections and is perpendicular thereto, and wherein respective second ends of the first and second side sections are disconnected from one another.

8. A valance as claimed in claim 7, wherein the first ends of the first and second side sections each form a mitered corner with the third side section.

9. A valance as claimed in claim 7, wherein the first, second and third side sections are each substantially rectangular.

10. A valance as claimed in claim 1, wherein the attachment portion is configured such that it has sufficient width that it can lie between the mattress and the bed frame.

11. A valance as claimed in claim 1, wherein the attachment portion and/or the skirt portion are inelastic.

12. A valance as claimed in claim 1, wherein the attachment portion comprises a single piece of fabric.

13. A valance as claimed in claim 1, wherein the skirt portion comprises a single piece of fabric.

14. A valance as claimed in claim 1, wherein the skirt portion is attached to an outer periphery of the attachment portion.

* * * * *